US008052502B2

(12) United States Patent
Connolly

(10) Patent No.: US 8,052,502 B2
(45) **Date of Patent: *Nov. 8, 2011**

(54) ILLUMINATED ARTIFICIAL EYE STRUCTURES FOR TOYS, MANNEQUINS AND THE LIKE

(76) Inventor: Sally Lee Connolly, Napa, CA (US)

( * ) Notice: Subject to any disclaimer, the term of this patent is extended or adjusted under 35 U.S.C. 154(b) by 145 days.

This patent is subject to a terminal disclaimer.

(21) Appl. No.: 12/458,759

(22) Filed: Jul. 22, 2009

(65) Prior Publication Data

US 2009/0298384 A1 Dec. 3, 2009

Related U.S. Application Data

(63) Continuation-in-part of application No. 11/271,951, filed on Nov. 14, 2005, now Pat. No. 7,566,258.

(60) Provisional application No. 60/628,432, filed on Nov. 17, 2004.

(51) Int. Cl.
*A63H 3/38* (2006.01)

(52) U.S. Cl. ..... 446/389; 446/392; 446/485

(58) Field of Classification Search ..... 446/175
See application file for complete search history.

(56) References Cited

U.S. PATENT DOCUMENTS

| | | | | | |
|---|---|---|---|---|---|
| 928,744 | A | | 7/1909 | Fisher | |
| 2,098,166 | A | | 11/1937 | Rubenstein et al. | |
| 2,647,195 | A | | 7/1953 | Broyles | |
| 2,794,298 | A | * | 6/1957 | Mason | 446/392 |
| 2,954,640 | A | | 10/1960 | Catalano | |
| 3,455,053 | A | | 7/1969 | Pembor | |
| 3,898,383 | A | * | 8/1975 | Herbits | 362/253 |
| 4,263,743 | A | | 4/1981 | Hanson et al. | |
| 4,305,223 | A | * | 12/1981 | Ho | 446/392 |
| 4,464,861 | A | * | 8/1984 | Fogarty et al. | 446/370 |
| 4,547,171 | A | | 10/1985 | Horimoto | |
| 4,585,424 | A | | 4/1986 | DeMars | |
| 4,734,074 | A | | 3/1988 | Kinberg et al. | |
| 4,752,273 | A | * | 6/1988 | Woods | 446/392 |
| 4,777,938 | A | * | 10/1988 | Sirota | 600/27 |
| 5,114,376 | A | | 5/1992 | Copley et al. | |
| 5,439,407 | A | * | 8/1995 | Friedel | 446/219 |
| 5,791,965 | A | * | 8/1998 | Kim | 446/219 |
| 6,048,209 | A | | 4/2000 | Bailey | |
| 6,165,037 | A | * | 12/2000 | Van Zant | 446/219 |
| 6,511,214 | B1 | | 1/2003 | Parsons et al. | |
| 6,514,117 | B1 | | 2/2003 | Hampton et al. | |

(Continued)

FOREIGN PATENT DOCUMENTS

| | | |
|---|---|---|
| DE | 29720813 | 1/1998 |

(Continued)

*Primary Examiner* — Melba Bumgarner
*Assistant Examiner* — Tramar Harper
(74) *Attorney, Agent, or Firm* — Donald Grant Kelly

(57) ABSTRACT

Simulated eye structure for plush toys, dolls, mannequins or other simulated or fanciful inanimate articles, sculptures, figurines and the like including at least one receptacle housing for a light source such as a light emitting diode. The receptacle housing has an external surface constructed as a substantially translucent cover having generally opaque regions representing iris/pupil and/or eyelid areas. The receptacle housing is provided with circuitry including a switch which may be a pressure activated type providing power to the light source. A timing circuit may be reset for circuitry activation cycles. The fabrication of the simulated eye structures with covered housings results in an inanimate article with softly illuminated eyes with uses ranging from retail advertising displays to interactive nightlights safely enjoyed by children as nighttime companions.

10 Claims, 2 Drawing Sheets

U.S. PATENT DOCUMENTS

| | | | |
|---|---|---|---|
| 6,663,393 | B1 | 12/2003 | Ghaly |
| 7,186,212 | B1 | 3/2007 | McMullen |
| 2007/0190510 | A1 | 8/2007 | Johnson |

FOREIGN PATENT DOCUMENTS

| | | | | |
|---|---|---|---|---|
| EP | 441566 | A | * | 8/1991 |
| EP | 441566 | A1 | | 8/1991 |
| JP | 2000313199 | | | 11/2000 |

* cited by examiner

ILLUMINATED ARTIFICIAL EYE STRUCTURES FOR TOYS, MANNEQUINS AND THE LIKE

CROSS REFERENCE TO RELATED APPLICATIONS

This application is a Continuation-in-Part of allowed U.S. Non-provisional patent application Ser. No. 11/271,951 filed Nov. 14, 2005 and now U.S. Pat. No. 7,566,258 issued on Jul. 27, 2009; which application in turn is entitled to the benefit of U.S. Provisional Patent Application Ser. No. 60/628,432 filed Nov. 17, 2004; wherein the contents of the above-noted applications in their entirety are hereby expressly incorporated herein by reference for all purposes, and all with benefits thereof claimed under 35 USC 120 and 35 USC 119(e), respectively.

STATEMENT REGARDING FEDERALLY SPONSORED RESEARCH OR DEVELOPMENT

Not applicable.

REFERENCE TO SEQUENCE LISTING

Not applicable.

REFERENCE TO MICROFICHE APPENDIX

Not applicable.

BACKGROUND OF THE INVENTION

The present invention relates to the field of plush and mechanical toys, stuffed animals and other fanciful creatures of play, as well as object representations configured to bear postural and visual verisimilitude with human adults or children, other mammals, fish, and insects configured, for instance, for display as mannequins, sculptures, taxidermy, figurines and the like. More directly, the present invention involves illuminated, artificial eye structures for inclusion in such products for interactive, playful entertainment, exhibition and/or merchandising and which are electromechanically adapted to provide a response or reaction when engaged by users.

The present invention relates particularly electrically powered illumination features for fanciful and a unique method of use thereof. Such figures, for example toys or mannequins typically would be readily manipulated or operated by users for their own purposes. The effect of light passing from a light source within the novel artificial eye structure housing and through a substantially translucent material surface fabric which is blocked by generally opaque regions of the fabric is to depict a softly glowing image of an open eye.

For generations, display mannequins and conventional toys, whether plush, stuffed or of the more rigid variety, have fascinated children and adults alike. Popular toys, collectables and inanimate figures have included plush or soft varieties ranging from the timeless Teddy Bear to the more contemporary BEANIE BABY®.

Still others of a more rigid nature are exemplified by typical department store mannequins such as those from Decter—American Mannequin or Greneker, both based in Los Angeles, Calif. or as illustrated in McMullen's U.S. Pat. No. 7,186,212. Then, there are the fantasy toys such as CABBAGE PATCH®, BARBIE®, GI Joe® and Furby® dolls. Toy planes, trucks and cars may be made to appear animated with (human-like) facial features such as eyes, nose, mouth, and ears, and may also be afforded a soft pushiness so as to join the space traditionally filled by the ubiquitous "Teddy."

From a review of the history of commercially available toys, sculptures and collectables of the types described above it is evident that continuous efforts, many of those successful, have been undertaken to enhance their value to prospective customers or more especially where small children are concerned. For example, plush and rigid toys alike may be provided with flexible limbs and other articulation features. With the help of clever inventors, such artifacts may seem to walk, bark, moo, sing, and even blush on command.

Many products of the type described hereabove are equipped with bells, rattles, squeakers, voice boxes, sirens, and a wide range of other sound producing elements and recorded message/playback devices. Recent high-tech features even enable dolls and/or plush toys to react to ambient conditions or to the presence of, or signals from, other similarly equipped toys. Toys now perform certain robotic tasks, simulate a conversation, and sense light and darkness. Such toys can be both entertaining and demanding. Realistic mannequins of all shapes and sizes can indeed influence consumer decisions.

Toys also may be equipped to make, or emit, light themselves. Devices have been devised to accessorize and enhance toys from the earliest days of light bulbs to the more recently introduced light emitting diodes. Lighting accessories play different roles in different applications. For example, they may provide toys, dolls and plush/stuffed animals with dazzling decorative features, or simply suggest humanesque qualities of character and warmth. They may generate entertaining light shows, or simply illuminate a room or pathway.

For example, Bailey's U.S. Pat. No. 6,048,209 presents a doll designed to provide an interactive experience for a caretaker as the doll demands feeding, picking up, and rocking. The doll communicates its needs by LED (light emitting diode) eyes. The eyes are lit when the doll is "awake." A crying sound is provided by a speaker that further offers burping sounds following "feeding." The LED changes colors and blinks in a coded manner to signal the doll's "needs." Of course, this doll is not for very young children or infants.

Gahly's U.S. Pat. No. 6,663,393 shows another high-tech version of an interactive doll. Eye and lip movements are simulated as well as skin color changes. An electromechanical device controlled by a micro-processor enables the eye and lip movements. Skin color changes are implemented using a plurality of LED's in various colors located inside the doll and also controlled by the microprocessor.

In U.S. Pat. No. 6,514,117, Hampton et al. show yet another high-tech interactive doll. This is believed to be one of the reactive Furby® line, and includes an audio sensor in the form of an interior microphone. Between the animal's eye openings a light sensor is mounted between an IR transmitter element and IR receiver element. This permits communication between a plurality of similarly equipped toys. Like the inventions of Gahly and Bailey, discussed above, the Hampton et al. toy is for action play, as compared to comforting, and apparently not for very young children.

Catalano, in U.S. Pat. No. 2,954,640, illustrates a doll that can be made to "cry" by pumping fluid from an internal container and through conduit outlets positioned adjacent the doll's eyes. In U.S. Pat. No. 5,114,376, Copley et al. illustrate a stuffed toy having an animal-shaped body and including a belly portion that can be illuminated. Electrical circuitry and a power source, triggered by a touch sensor of a well known variety, generate a current flow to illuminate a dome-shaped member at the belly portion. A timer circuit automatically turns of the illumination source a predetermined time after is has been activated by touching the touch sensor.

Illustrated by DeMars in U.S. Pat. No. 4,585,424 is another animal-shaped toy (in this instance a bear is simulated) equipped with imaginative lighting that provides the bear with a bashful demeanor. Lamps are positioned behind the bear's face and activated by a manual pressure switch. As the lamps illuminate, the bear appears to blush.

Fisher, in U.S. Pat. No. 928,744 shows an early 20$^{th}$ Century version of a stuffed bear, provided with a lighted nose and movable jaw. An external switch activates the animal's nose and jaw. It is not uncommon to use electric light bulbs or, more recently, LED's to represent the eyes of a doll, stuffed animal or other novelty toy. For example, in U.S. Pat. No. 4,263,743 Hanson et al. depict a novelty toy in the form of a skull having lights placed in the eye sockets, and made to generate different shades of color. Rubenstein's U.S. Pat. No. 2,098,166 illustrates a combined tail-wagging, eye blinking device where lights are placed in a simulated dog's head.

Kinberg et al. present U.S. Pat. No. 4,734,074 demonstrating a stuffed toy simulating an animated creature, as for example an owl. The creature includes eyes depicted by light bulbs or LED's of the blinking variety. The body of the device is formed of a resilient or flexible material such that when pressed it will return to its original shape. Within the body is a collapsible bellows associated with a voice box that will generate a sound associated with the animated creature.

Also associated with the bellows of the Kinberg et al. device is an electrical circuit and power source connected with the blinking light bulbs or LED's. This is meant to be sufficiently interesting to a small child who would squeeze the toy so as to force air through the voice box thus generating a simulated creature sound (e.g., a "hoot"). Simultaneously with the voice box sound or, as suggested, independently, interconnection between the power source and bulbs/LED's will activate the blinking lights.

Kinberg et al. go on to state that this joint activity (i.e., blinking lights and sound) greatly adds to the play value of the device and enhances the child's enjoyment. While this device would be entertaining, it could hardly be comforting. Further, this toy lacks concern for safety measures with respect to exposed bulbs/LED's. This toy, in Applicant's estimation, would not be a preferred toy for a small child's bed.

Unlike other toys discussed above, patentee Woods recognizes the hazards of exposed bulbs/LED's in his depiction, in U.S. Pat. No. 4,752,273, of yet another toy configured as a doll or other animal. Woods' toy includes a pair of eyes fashioned with two flashlight bulbs. These bulbs are mounted within pupil passages in the toy's eyes and connected to a source of electrical energy by means of an externally operated switch. As a safety feature, the passages are restricted to prevent accidental removal of the bulbs. The Woods toy and others discussed herein as having lights or diodes replicating eyes fall short in the simulation of eyes. Mannequins, too, may be provided realistic eyes as shown by Pembor in U.S. Pat. No. 3,455,053 deploying simulated eyelashes formed from "imporous (sic.) braid." Another inventor Johnson presents artificial eyes inserted and aligned in taxidermy mannequins or lifelike sculptures in US Published Patent Application No. 20070190510. Johnson, by the way, temporarily employs a light source positioned behind eye pupils for sight alignment of the eyes.

U.S. Pat. No. 6,511,214 granted to Parsons et al. is referenced herein for its discussion of diodes powered by batteries and controlled by pressure switches. Of particular interest is the discussion of well known micro light technology involving diodes and pressure switches, and the improvements described as the Parsons et al. invention. Included in Parsons et al. are different kinds of LED's and suggested applications therefor.

Regardless of their intensity and precise placement, internal light sources are perceived in the prior art only as brightly lit spots; not as actual eyes with pupils and expressions. Exposed light sources may prove unsafe for users. Bulbs or LED's may be forced from their sockets even by a relatively young child or infant, and easily broken or swallowed. Removal of bulbs/diodes from the wiring circuits pose further obvious hazards.

Despite continued technical advances and a growing variety of ancillary features, prior art mannequins and toys of the plush or doll type fall short of engendering in the consumer a sense of connection. Users of inanimate mannequins, toys and the like desire a simulated inanimate human, animal or other fanciful characterizations endowed with a capability for seemingly conveying a sense of connectivity and security, and to do so in a safe manner. The present invention effectively resolves the shortcomings and inadequacies of the prior art in satisfying a long felt need. For all purposes as appropriate, the above discussed patent documents in their entirety are hereby incorporated by reference herein.

BRIEF SUMMARY OF THE INVENTION

The invention presented herein is specifically configured and applied to provide artificial eyes with illuminated or glowing parts to an electrically (battery or wire connection) powered switch-operated plush toy, doll, mannequin or the like (for simplicity, generically referred to henceforth as the inanimate article). An illuminating light source such as a light emitting diode (LED) or other bulb is mounted inside designated glowing parts which may represent one or more glowing eyes of the inanimate article. While a standard light bulb of the type utilized in typical flashlights may be employed as a light source, the diode often is preferred particularly for toy implementation or uses requiring longevity. The following description suggests the LED, though certainly not intended as limiting in any respect the present invention.

This relatively cool and very safe diode element is positioned beneath or behind an external surface or surfaces of the designated glowing parts of the inanimate article so as to internally illuminate such parts when the light source is activated. For example, a battery powered source may be located within a toy, mannequin or the like with a wiring circuit within the article body that electrically connects the battery power source and the light emitting source.

The battery power source, in the above example, activates the light emitting device when its switch is manually operated as for example by manual pressure. The toy may further include a timing circuit for automatically de-energizing the light source after a predetermined period. For example, and in no way limiting as to the scope of appended claims, such period may be two minutes or less, or as long as a number of hours. In particular, the present invention may provide a toy which is safe and especially suitable for use by young children for creative play and especially at bedtime. Such a toy would typically have a pair of glowing eyes, but of course may include only a single eye or perhaps more than two. Similarly, this invention may produce a mannequin with a display of glowing eyes as a compelling feature of a department store's window display, and pre-set for self-extinguishing at store closing time.

In a method of using the invention as a unique toy, a small child ready for sleep would engage the toy so as to activate the circuit and illuminate the eyes. The child will continue to enjoy the toy as the room lights are extinguished. If the timing circuit completes its cycle and the illumination of the toy's artificial eyes ceases, the child can simply apply manual pressure on the toy to restore illumination and continue creative play until both the child and the toy are "asleep."

The external surface material of the mannequin or plush toy (beneath which the LED may be mounted) can, depending on the particular application, include a variety of hard or soft material, but substantially translucent so as to pass light from the LED, thus simulating the eye of the human-like form, animal or other creature represented by the inanimate article. As an added feature, the external surface further includes generally opaque portions or regions of the simulated eye, which region is formed in the shape of one or more eyelids and a simulated pupil/iris configuration.

Thus, as light passes from the LED or other light source through the substantially translucent material surface and blocked by generally opaque regions, the effect is to display a glowing image of an open eye. The opaque regions may be small or large relative to the overall eye surfaces, and may be relatively positioned in a manner so as to lend entertaining facial expressions to a face portion material of the mannequin or toy. For convenience, and not to be considered as limiting the scope of the invention defined by claims herebelow, the illustrated example that follows takes the form of a plush toy.

BRIEF DESCRIPTION OF THE DRAWINGS

The invention will be best understood by reference to the following detailed description of an illustrative embodiment when read in conjunction with the accompanying drawings, wherein.

DETAILED DESCRIPTION OF THE INVENTION

Figure 1:
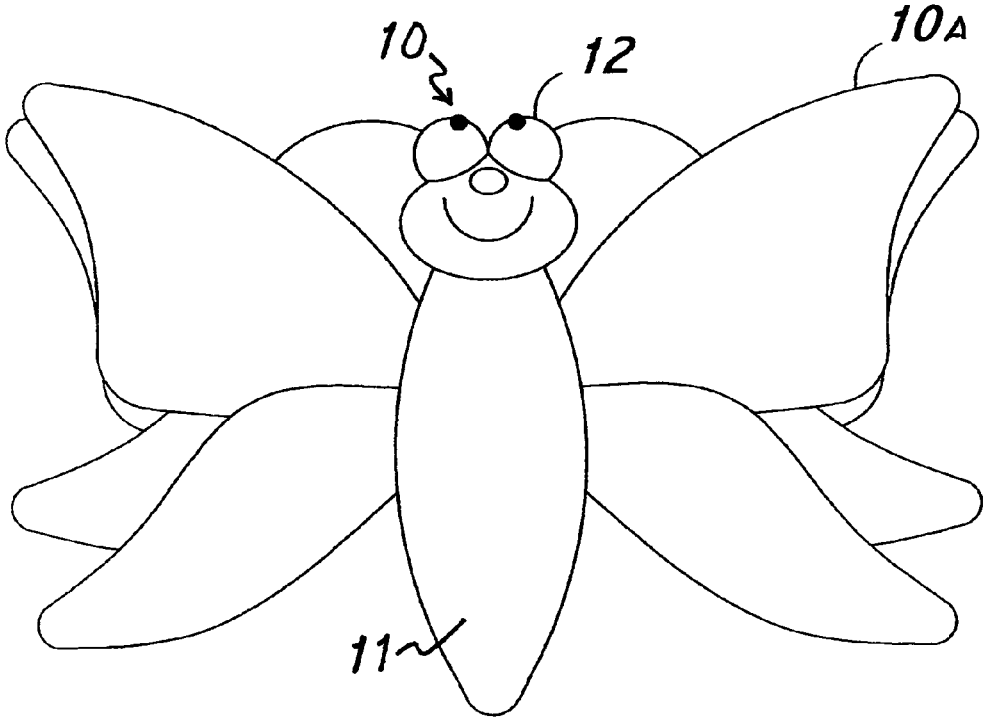
FIG. 1 is a bottom view of a plush toy or inanimate article generally representative of the present invention.

The plush toy example is illustrated in a bottom view, FIG. 1, in the form of an artificially animated firefly 10 (by way of example) with soft, generally transparent wings 10A and flexible body 11. The flexible body 11 may include soft fabric stitched together in panel sections as is well known in the art. Said panel sections may be formed of any suitable material which may include natural textile cloth or synthetic fabric. Firefly 10 further displays an exterior surface of LED receptacle housings 12 in the form of eyes.

Figure 2:
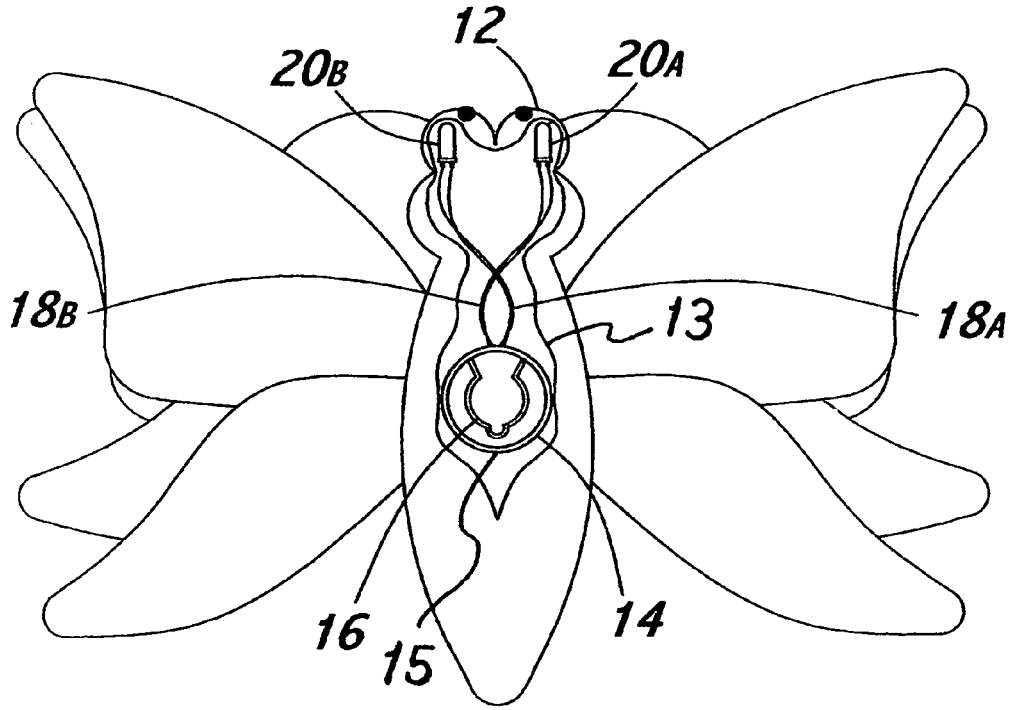
FIG. 2 illustrates a battery powered device suggested for the interior of the plush toy or inanimate article of FIG. 1.

FIG. 2 shows a portion 13 of the firefly FIG. 10 body 11 removed to reveal an interior housing for the LED control elements 15. Receptacle housings 12 (or "eyes") are defined by external fabric panel coverings having inner and outer faces integrally fixed to said body 11 face portion material. Such external fabric panel coverings are substantially translucent elements attached or integral with the plush toy face portion material, so as to allow passage of a glowing light from light sources such as diodes 20A and 20B through said external fabric panel coverings. The eye-defining external fabric panel coverings of receptacle housings 12 further include fixed opaque regions or spots 12A that visually simulate iris/pupil portions of the eyes, and fixed opaque regions 12B simulate eyelids. As is clearly evident in FIG. 2 and other drawing images herein depicting fanciful figures, each "eye" structure comprises a fabric panel covering integrally fixed to the fanciful figure face portion material.

The LED control elements 15 include a compression plate 16, battery switch 14 and timing circuit 60, all of which are conventional in the toy art as noted in the prior art discussion hereabove in the discussion of prior art patents, each of which is hereby incorporated by reference. The light emitting devices 20A and 20B within receptacle housings 12 are activated when compression plate 16 is compressed causing battery switch 14 to send signal through wires 18A and 18B interconnected to devices 20A and 20B.

Thus the light sources or LED's 20A and 20B project light against the inner face of said substantially translucent external fabric panel coverings of receptacle housings 12. As noted above, the toy body 11 may include an external surface made up of stitched fabric panels. Receptacle housings 12 include substantially translucent fabric panel coverings such that the "eyes" will appear illuminated on the fabric panel covering outer face with a soft glow except where the opaque regions 12A and 12B are located. The contrast between the opaque (light-blocked) and the lighted regions of the receptacle housings 12 distinctly defines images of eyes for the plush toy.

Figure 3:
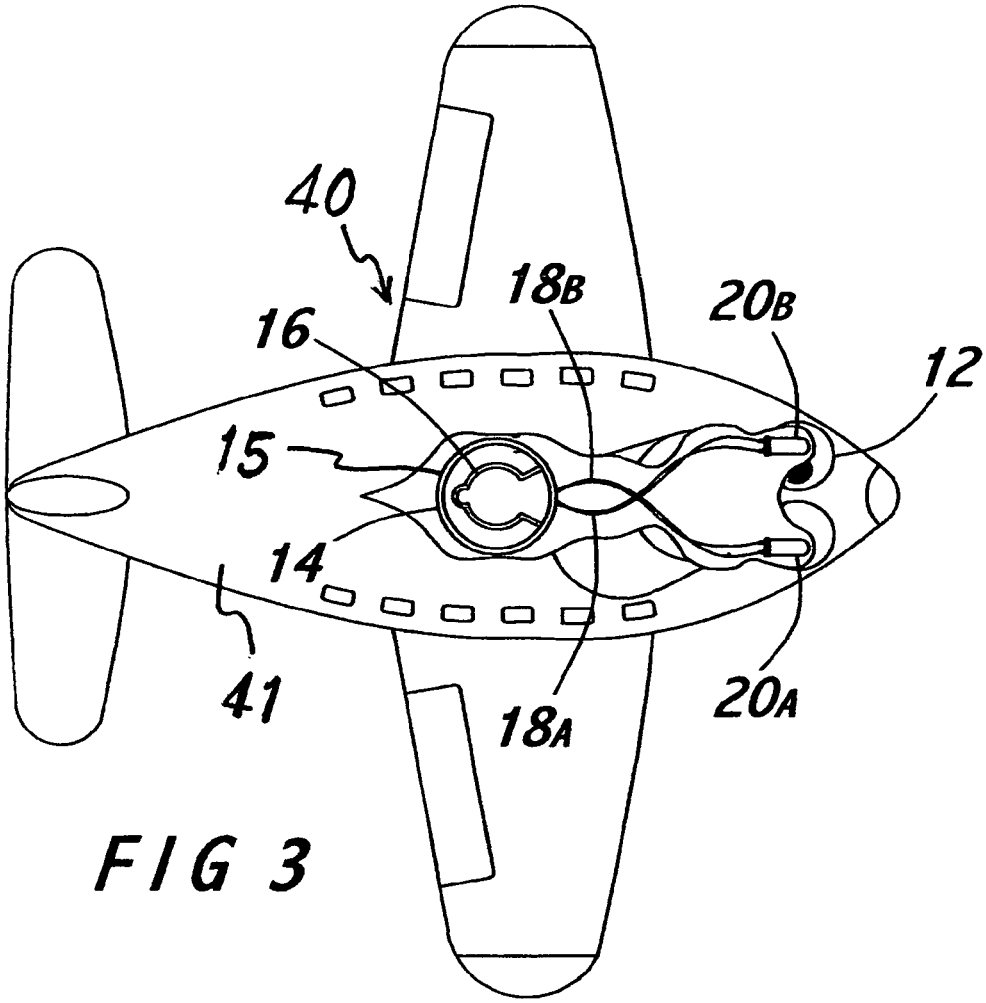
FIG. 3 shows a top elevation of another embodiment of plush toy of the present invention partially opened to show a battery powered device in its interior.

FIG. 3 shows a top view of a second embodiment of the present plush toy formed as an animated airplane 40. A portion 42 of the toy airplane body 41 is shown removed to reveal an interior housing for the LED (or other light source) control elements 15. As in the firefly 10 embodiment described above, receptacle housings 12 (or "eyes") are translucent elements attached to or integral with the plush toy airplane so as to permit passage of glowing light from light sources or diodes 20A and 20B. Note that opaque spots 12A and 12B are illustrated as simulating an iris/pupil and lid so as to enhance the "eye" effect.

Again, as discussed above, the control elements 15 include a compression plate 16, battery switch 14 and timing circuit 60. As noted above, such circuitry for powering a light source or LED through means of a pressure switch, battery and associated wires is well known as demonstrated in the prior art. The light sources or LED's 20A and 20B in receptacle housings 12 are activated upon pressure delivered to plate 16. This results in a current feed via wires 18A and 18B acting to energize, or light-up, the light sources or LED's.

Light emitted through the external surface of receptacle housings 12 will appear as a soft glow (as opposed to the flash or glare of uncovered bulbs/LED's) since the covering surface is constructed of a translucent material. This creates the display of a softly lit eye, enhanced by the opaque spots 12A, simulating iris and pupil portions of the eyes, and 12B, simulating eyelid portions.

Figure 4:
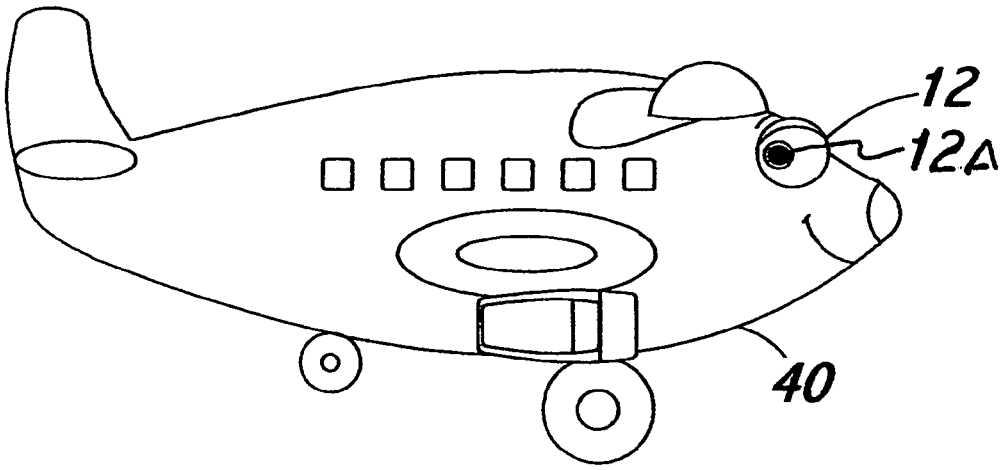
FIG. 4 shows a side elevation view of the plush toy or inanimate article embodied as an airplane.

FIG. 4 illustrates a side view of the airplane plush toy 40, where an eye (receptacle housing 12) is shown with the iris and pupil portion 12A and eyelid portion 12B positioned, for example, so as to impart a pleasant whimsical appearance. In the case of airplane 40, the eyes (receptacle housings 12) are placed at a location where a pilot/copilot windshield would be positioned (on a real plane).

On simulated trucks and cars (not shown) the eyes (receptacle housings 12) would represent headlights. For mannequins or sculpture simulating humans, animals or other creatures the receptacle housing could be pre-formed of material consistent with the fabric or substance of the inanimate article itself. The covering material detailed with substantially opaque iris/pupil and lid portions and defining the eye need only be substantially translucent so as to depict a softly lit eye. Thus, a vast variety of vehicles (such as racecar, ambulance, school bus, fire truck, train engine, police car) and simulated living creatures (such as honeybee, butterfly, ladybug, caterpillar, grasshopper, bear, dog, cat, horse, donkey, alligator, humans, other mammals and so on), or other fanciful representations can be simulated in applying the present invention, without departing from the scope defined in the appended claims.

It is believed that the most powerful sense of connectivity between humans is through personal touch and interaction between the eyes. The same holds true for humans and certain domestic pets such as dogs and cats. While countless animated toys or other artifacts have been equipped with lighted eyes or faces or other specialty features so as to appear demonstrative or communicative, their connectivity remains minimal, if it exists at all. On the other hand, the present invention with softly backlit, translucent eyes (receptacle housings 12) conveys instant connectivity possibilities for consumers and/or children at play. One very good example is the use of the present invention by a child at bedtime.

It is well known that most children have difficulty at bedtime when the time for lights to be turned out. Small children find it easier to fall asleep if a night light or other soft light is glowing in the bedroom or shining from an adjacent hallway. They also require the comfort of a cuddly friend in the form of a plush toy or other favorite doll. The present invention employs light sources or LED's in a safe, novel and non-obvious way to bring a sense of joy, security and comfort to a small child in transition from wakefulness to sleep.

Once in bed, the child will happily allow the bedroom lights to be extinguished as long as she/he can view the softly glowing eyes of a companion plush toy. The toy playfully simulates animals, insects, reptiles, prehistoric creatures or the like having small light emitting diodes representing eyes. In lieu of a nightlight, the toy eyes are effortlessly energized by simply pressing a body portion of the toy. As the diode circuit timer runs its cycle, the glow will fade as the plush toy "falls asleep." If the child wishes to continue play, the timer cycle may be repeated.

Another example has a setting in a modern department store with an array of clothing mannequins on display, each including the unique, artificial eye structures described hereinabove. Each is timed, in turn, to emit a soft eye glow with pupils/irises and/or eyelids positioned or directed so as to draw the consumers focus to a particular outfit or article of clothing. As with the plush toy described hereabove, a mannequin's facial expression inferred by relative placement of the opaque and lighted regions on the outer face of the receptacle housings may serve to evoke shyness, sadness, flirtation, surprise and so on.

Although various embodiments of the present invention have been described in the foregoing detailed description and illustrated in the accompanying drawings, it will be understood that the invention is not limited to the embodiments disclosed, but may assume numerous arrangements, rearrangements, modifications, and substitutions of steps without departing from the spirit of the invention nor from the scope of the following claims.

I claim:

1. At least one simulated eye structure for article a fanciful inanimate figure including a figure body face portion material, said simulated eye structure comprising:

at least one receptacle housing configured for placement within said body face portion material;

at least one light emitting light source located within said at least one receptacle housing;

said light source enclosed at an outside surface of said at least one receptacle housing by an eye-defining external fabric panel covering having an inner and outer face, wherein the at least one receptacle housing is significantly larger than said at least one light source;

said eye-defining fabric panel covering integrally fixed to said body face portion material;

said eye-defining external fabric panel covering being at least in part substantially translucent and configured to limit transmission of said emitted light to a soft glow and further including at least one generally opaque portion configured in the shape of a simulated pupil/iris to substantially block soft glow emitted when said at least one light source is activated to simulate a soft glowing eye;

said at least one receptacle housing configured to permit and guide emitted light from said light source through said fixed, eye-defining external fabric panel covering, thus forming said simulated eye;

a power source interconnected to said at least one light source; and a manual pressure switch configured to activate said power source so as to furnish current to said at least one light source;

whereby pressure on said switch activates said power source, furnishing current to said light source such that light therefrom within said receptacle housing is directed against said inner face of said substantially translucent eye-defining, external fabric panel covering, resulting in at least one simulated, softly backlit translucent eye at said outer face of said eye-defining panel covering.

2. The simulated eye structure of claim 1 further defined as having:

a pair of receptacle housings configured for placement within said body portion;

a light emitting light source respectively positioned within each of said housings;

each said light source is enclosed at an outside surface of said receptacle housings by an eye-defining external fabric panel coverings having inner and outer faces, wherein the receptacle housings are significantly larger than said light sources;

said eye-defining fabric panel covering integrally fixed to said body face portion material;

said eye-defining external fabric panel coverings being at least in part substantially translucent and configured to limit transmission of said emitted light to a soft glow and further including generally opaque portions configured in the shape of simulated pupils/irises to substantially block soft glow emitted when said light sources are activated to simulate soft glowing eyes;

said light source receptacle housings configured to permit and guide emitted light from said light sources through said fixed, eye-defining external fabric panel coverings, thus forming said simulated eyes.

3. The simulated eye structure of claim 2 further defined by:

said eye-defining external fabric panel coverings further including generally opaque portions configured in the shape of simulated eyelids to substantially block soft glow emitted when said light sources are activated to simulate soft glowing eyes;

said power source is interconnected to said light sources;

said switch is interconnected to said power source and light sources;

whereby pressure on said switch activates said light sources and causes the receptacle housings to emit a soft glow at said outer faces of said fixed eye-defining panel coverings so as to simulate a pair of softly backlit translucent eyes.

4. The simulated eye structure of claim 3 wherein each said light source is a light emitting diode.

5. The simulated eye structure of claim 2 wherein each said light source is a light emitting diode.

6. The simulated eye structure of claim 1 further including a timer circuit interconnected to said switch;

whereby said timer circuit is configured to limit a time period for switch activation.

7. The simulated eye structure of claim 6 wherein said at least one light source is a light emitting diode.

8. The simulated eye structure of claim 1 further defined by:

said eye-defining external fabric panel covering further including at least one opaque portion configured in the shape of a simulated eyelid to substantially block soft glow emitted when said at least one light source is activated to further simulate a soft glowing eye.

9. The simulated eye structure of claim 8 wherein said at least one light source is a light emitting diode.

10. The simulated eye structure of claim 1 wherein said at least one light source is a light emitting diode.

* * * * *